US008129913B2

(12) United States Patent
Duchemin et al.

(10) Patent No.: US 8,129,913 B2
(45) Date of Patent: Mar. 6, 2012

(54) CLOSED ELECTRON DRIFT THRUSTER

(75) Inventors: Olivier Duchemin, Magny les Hameaux (FR); Dominique Valentian, Rosny sur Seine (FR)

(73) Assignee: SNECMA, Paris (FR)

( * ) Notice: Subject to any disclaimer, the term of this patent is extended or adjusted under 35 U.S.C. 154(b) by 285 days.

(21) Appl. No.: 12/693,705

(22) Filed: Jan. 26, 2010

(65) Prior Publication Data

US 2010/0188000 A1 Jul. 29, 2010

(30) Foreign Application Priority Data

Jan. 27, 2009 (FR) ..... 09 50486

(51) Int. Cl.
*H05B 31/26* (2006.01)

(52) U.S. Cl. ..... 315/111.81; 315/111.91

(58) Field of Classification Search ..... 315/500, 315/501, 505, 506, 111.41, 111.51, 111.81, 315/111.91; 313/153, 157, 158, 161, 359.1, 313/618

See application file for complete search history.

(56) References Cited

U.S. PATENT DOCUMENTS 5,359,258 A 10/1994 Arkhipov et al.
6,612,105 B1 9/2003 Voigt et al.
6,777,862 B2 * 8/2004 Fisch et al. ..... 313/359.1
7,030,576 B2 * 4/2006 McVey et al. ..... 315/501
7,459,858 B2 * 12/2008 Hruby et al. ..... 315/111.21
2006/0290287 A1 12/2006 Kuninaka

OTHER PUBLICATIONS

Zhurin, V. et al., "Physics of closed drift thrusters," Plasma Sources Science and Technology, Institute of Physics Publishing, GB, vol. 8, No. 1, Feb. 1, 1999, pp. R1-R20.

* cited by examiner

*Primary Examiner* — Douglas W Owens
*Assistant Examiner* — Minh D A
(74) *Attorney, Agent, or Firm* — Weingarten, Schurgin, Gagnebin & Lebovici LLP

(57) ABSTRACT

In a closed electron drift thruster, a magnetic circuit for creating a magnetic field in a main annular channel comprises at least one axial magnetic core surrounded by a first coil and an inner upstream pole piece forming a body of revolution, together with a plurality of outer magnetic cores surrounded by outer coils. The magnetic circuit further comprises an essentially radial outer first pole piece defining a concave inner peripheral surface and an essentially radial second pole piece defining a convex outer peripheral surface. The concave inner peripheral surface and the convex outer peripheral surface present respective adjusted profiles that are distinct from circular cylindrical surfaces so as to form between them a gap of varying width presenting zones of maximum value in register with the outer coils and zones of minimum value in between the outer coils so as to create a uniform radial magnetic field.

8 Claims, 4 Drawing Sheets

CLOSED ELECTRON DRIFT THRUSTER

FIELD OF THE INVENTION

The present invention relates to a closed electron drift thruster comprising a main annular ionization and acceleration channel about an axis of the thruster, at least one hollow cathode, an annular anode concentric about the main annular channel, a pipe and a manifold for feeding the anode with ionizable gas, and a magnetic circuit for creating a magnetic field in said main annular channel, said magnetic circuit comprising at least one axial magnetic core surrounded by a first coil and by an inner upstream pole piece forming a body of revolution, and a plurality of outer magnetic cores surrounded by outer coils.

PRIOR ART

Various types of closed electron drift thruster are already known.

A first type of closed electron drift thruster includes an outer pole piece that is magnetized by an annular coil.

A thruster of that type with a shielded outer coil is described for example in document EP 0 900 196 A1.

Patent document FR 2 693 770 A1 also describes a closed electron drift thruster with three coils, including an annular outer coil.

FIG. 8 is an elevation view in axial half-section of an example of a closed electron drift thruster having an outer annular coil 31 as described in document FR 2 693 770 A1.

That prior art thruster 20 has a main annular channel 24 for ionization and acceleration that is defined by parts 22 made of insulating material and that is open at its downstream end 225, at least one hollow cathode 40 associated with means 41 for feeding an ionizable gas, and an annular anode 25 concentric with the main annular channel 24 and located at a distance from the open downstream end 225. The anode 25 is placed on insulating parts 22 and is connected by an electrical line 43 to the positive pole of a direct current (DC) voltage source 44, which may be at 200 volts (V) to 300 V, for example, and that has its negative pole connected by a line 42 to the hollow cathode 40 that is associated with a circuit 41 for feeding ionizable gas such as xenon. The hollow cathode 40 delivers a plasma 29 substantially at the reference potential from which the electrons are extracted, going towards the anode 25 under the effect of an electrostatic field E due to the potential difference between the anode 25 and the cathode 40. A circuit 26 for feeding ionizable gas opens out upstream from the anode 25 through an annular manifold 27.

Control over the gradient of the radial magnetic field in the main annular channel 24 is obtained by the positioning of inner annular coils 32 and 33, and an outer annular coil 31, together with inner and outer pole pieces 35 and 34, the inner pole piece 35 being connected by a central core 38 and the outer pole piece being connected by connection bars 37 to a yoke 36 that may be protected by one or more layers 30 of super-insulating lagging material.

Closed electron drift thrusters having an annular outer coil, such as the prior art thruster shown in FIG. 8, guarantee a constant radial magnetic field in the gap defined between the outer and inner pole pieces 34 and 35.

Nevertheless, for space missions that require high power and high specific impulse, closed electron drift plasma thrusters present drawbacks in thermal terms since the outer annular coil involves a long length of wire which gives rise to a high level of heat dissipation and to a winding that is of mass that is likewise high. In addition, the outer annular coil 31 impedes cooling of the ceramic channel 24, in particular in the downstream portion that has the greatest thermal load.

A second type of closed electron drift thruster is also known in which a large outer annular coil centered on the axis of the thruster is not used, but instead a plurality of small coils are used that are distributed at the periphery of the thruster and that serve to magnetize the outer pole piece.

Thus, patent document EP 0 982 976 B1 describes a thruster having a plurality of outer coils and that is adapted to high thermal loads.

Patent document U.S. Pat. No. 6,208,080 B1 and U.S. Pat. No. 5,359,258 also describe thrusters each having four outer coils.

Another closed electron drift thruster, known under the name ALT D55, implements three outer coils. Such an ALT D 55 closed electron drift thruster is described in the article AIAA-94-3011-30$^{th}$ Conference of the AIAA on Propulsion, entitled "Operating characteristics of the Russian D-55 thruster with anode layer" by John M. Sankovic and Thomas X. Haag, NASA Lewis Research Center, Cleveland, Ohio, and Davis H. Manzella, Nyma Inc., Brook Park, Ohio—and also in the article AIAA-94-3010—same Conference, entitled "Experimental evacuation of Russian anode layer thrusters", by C. Garner, J. R. Bropy, J. E. Polk, S. Semenkin, V. Garkuska, S. Tverdokhelbov, and C. Marrese.

Nevertheless, it has been found that the radial magnetic field delivered by the multiple outer coil thrusters is not rigorously uniform, with variations that may be as great as several percent.

Unfortunately this non-uniformity of the radial magnetic field gives rise to serious problems when the thrusters present high power or operate at high voltage. It has thus been found that because plasma confinement is directly associated with the intensity of the magnetic field, small variations in the magnetic field give rise to plasma-wall interaction that varies in azimuth and that harms the efficiency and the potential lifetime of the thruster. Furthermore, in order to be certain to achieve the desired magnetic field at all points of the annular channel, it is necessary to increase the magnetic potential, i.e. the number of ampere turns of the coils, on the basis of those zones where the magnetic field presents its lowest value, thereby increasing the mass of the winding.

OBJECT AND SUMMARY OF THE INVENTION

The present invention seeks to remedy the above-mentioned drawbacks and to enable a high power closed electron drift thruster to be made that simultaneously benefits from good cooling of the main annular channel, enables a uniform radial magnetic field to be obtained within said channel, and minimizes the length of wire needed for the windings, and consequently minimizes the mass of the windings.

In accordance with the invention, these objects are achieved by a closed electron drift thruster comprising a main annular ionization and acceleration channel about an axis of the thruster, at least one hollow cathode, an annular anode concentric about the main annular channel, a pipe and a manifold for feeding the anode with ionizable gas, and a magnetic circuit for creating a magnetic field in said main annular channel, said magnetic circuit comprising at least one axial magnetic core surrounded by a first coil and by an inner upstream pole piece forming a body of revolution, and a plurality of outer magnetic cores surrounded by outer coils, wherein said magnetic circuit further comprises an essentially radial outer first pole piece defining a concave inner peripheral surface, and an essentially radial inner second pole piece defining a convex outer peripheral surface, and wherein said concave inner peripheral surface and said convex outer peripheral surface present respective adjusted profiles that are distinct from circular cylindrical surfaces so as to form between them a gap of varying width presenting zones of maximum value in register with the outer coils, and zones of minimum value in between said outer coils so as to create a uniform radial magnetic field.

In a first possible embodiment, said inner upstream pole piece forming a body of revolution is essentially conical and defines a profiled peripheral margin at its free end that is closer to said cathode.

Under such circumstances, according to the invention, said magnetic circuit further comprises an essentially conical outer upstream pole piece that defines a profiled peripheral margin at its free end closer to said cathode, and said profiled peripheral margin of said essentially conical inner upstream pole piece forming a body of revolution and said profiled peripheral margin of said essentially conical outer upstream pole piece present respective adjusted profiles with portions set back along the axis of the thruster in register with the outer coils in such a manner as to keep the profile of the magnetic field constant in azimuth.

In another possible embodiment, said inner upstream pole piece forming a body of revolution comprises an essentially cylindrical inner magnetic shield defining a profiled peripheral margin at its free end close to said cathode.

Under such circumstances, according to the invention, said magnetic circuit further comprises an essentially cylindrical outer magnetic shield that defines a profiled peripheral margin at its free end closer to said cathode, and said profiled peripheral margin of said inner magnetic shield and said profiled peripheral margin of said outer magnetic shield present respective adjusted profiles with proportions set back along the axis of the thruster in register with the outer coils so as to keep the magnetic field profile constant in azimuth.

The thruster of the present invention preferably has four outer coils surrounding four outer magnetic cores.

Nevertheless, given the measures recommended by the invention, it is also possible to obtain excellent results with three outer coils surrounding three outer magnetic cores, or even with two outer coils surrounding two outer magnetic cores.

BRIEF DESCRIPTION OF THE DRAWINGS

Other characteristics and advantages of the invention appear from the following description of particular embodiments given by way of example and with reference to the accompanying drawings, in which.

DETAILED DESCRIPTION OF PREFERRED EMBODIMENT

Figure 1:
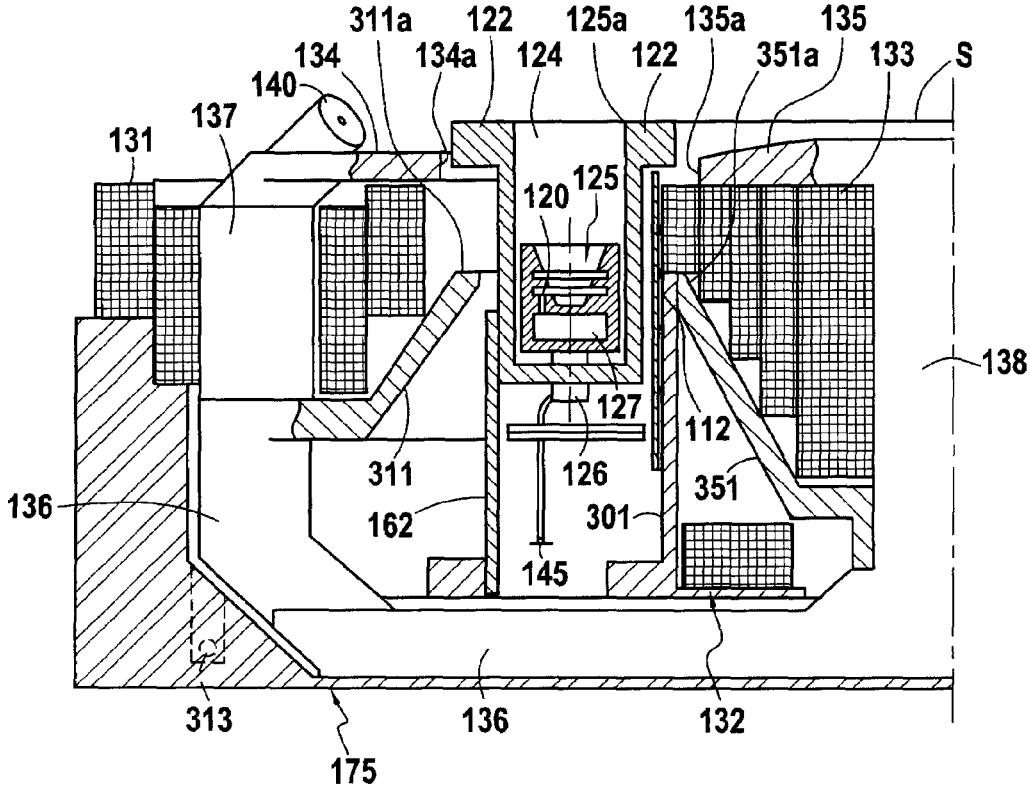
FIG. 1 is an axial half-section view of a closed electron drift thruster constituting a first embodiment of the invention.

FIGS. 1 to 4 show a first embodiment of a closed electron drift thruster to which the present invention applies.

A thruster of this type comprises a basic structure that corresponds to a large extent to the description that is given in patent document EP 0 982 976.

The plasma thruster thus essentially comprises a main annular ionization and acceleration channel 124 defined by insulating walls 122. The channel 124 is open at its downstream end 125*a* and in an axial plane it presents a section of frustoconical shape in its upstream portion, and of cylindrical shape in its downstream portion. A hollow cathode 140 is placed outside the main channel 124 and an annular anode 125 is placed in the main channel 124. An ionizable gas manifold 127 fed by a pipe 126 serves to inject ionizable gas through holes 120 formed in the wall of the anode 125. A wire 145 for biasing the anode 125 can also be seen in FIG. 1.

Discharge between the anode 125 and the cathode 140 is controlled by a magnetic field distribution that is determined by a magnetic circuit comprising an outer pole piece 134 that is essentially radial and that defines an inner peripheral surface 134*a* that is concave.

The outer pole piece 134 is connected by a plurality of magnetic cores 137 surrounded by outer coils 131 to another outer pole piece 311 of essentially conical shape that defines a profiled peripheral margin 311*a* at its free end that is closer to the cathode 140.

The magnetic circuit also has an inner pole piece 135 that is essentially radial and that defines an outer peripheral surface 135*a* that is convex.

The inner pole piece 135 is extended by a central axial magnetic core 138 surrounded by an inner coil 133. The axial magnetic core 138 is itself extended at the upstream portion of the thruster by a connection portion connected to another inner pole piece 351 that is located upstream and that is conical in shape, with the apex of the cone preferably being directed upstream (see FIGS. 1 and 2). It should be observed that throughout the present description, the term "downstream" signifies a zone close to the outlet plane S and the open end 125*a* of the channel 124, while the term "upstream" designates a zone remote from the outlet plane S and going towards the closed portion of the annular channel 124 fitted with the anode 125.

An additional internal magnetic coil 132 may be placed in the upstream portion of the inner pole piece 351 on the outside thereof. The magnetic field of the coil 132 is channeled by the outer and inner pole pieces 311 and 351, and also by radial arms 136 connecting the axial magnetic core 138 to the outer magnetic cores 137.

The coils 133, 131, and 132 may be cooled directly by conduction via a structural base 175 made of thermally conductive material that also serves as a mechanical support for the thruster.

The number of outer coils 131 may lie in the range two to eight and is preferably equal to three or four, which coils are provided with magnetic cores 137 disposed between the outer pole pieces 134 and 311. The use of such outer coils 131 allows a large fraction of the radiation coming from the outer wall of the annular channel 124 to pass through. The conical shape of the outer pole piece 311 serves to increase the volume available for the outer coils 131 and to increase the solid angle of the radiation. Furthermore, the conical outer pole piece 311 is advantageously perforated so as to increase the view factor of the ceramic parts 122, thereby obtaining a magnetic circuit that is very compact but with large spaces, thereby enabling all of the side face of the channel 124 to radiate.

The closed electron drift plasma thruster of the present invention is adapted to high powers, given that it enables good cooling of the main annular channel, it minimizes the length of wire needed for the windings by implementing a plurality of outer coils 131 instead of a single annular coil of large diameter, and furthermore measures are taken to guarantee that a uniform radial magnetic field is obtained within the channel 124.

The term "uniform magnetic field profile in the acceleration channel 124" is used herein to mean that the magnetic field is identical in the channel 124 in all planes containing the axis of the thruster.

Figure 2:
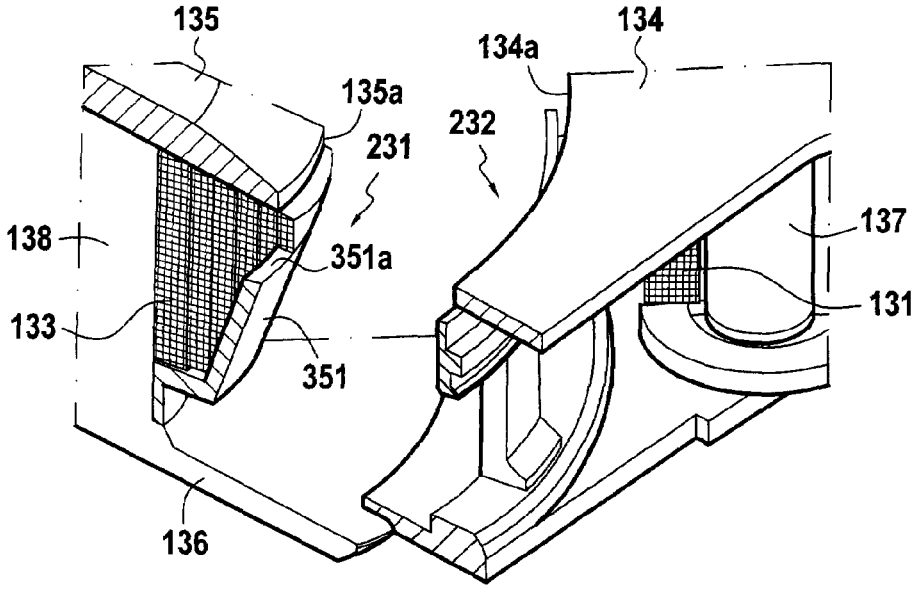
FIG. 2 is a diagrammatic fragmentary view in perspective of certain elements of the FIG. 1 thruster.
Figure 3:
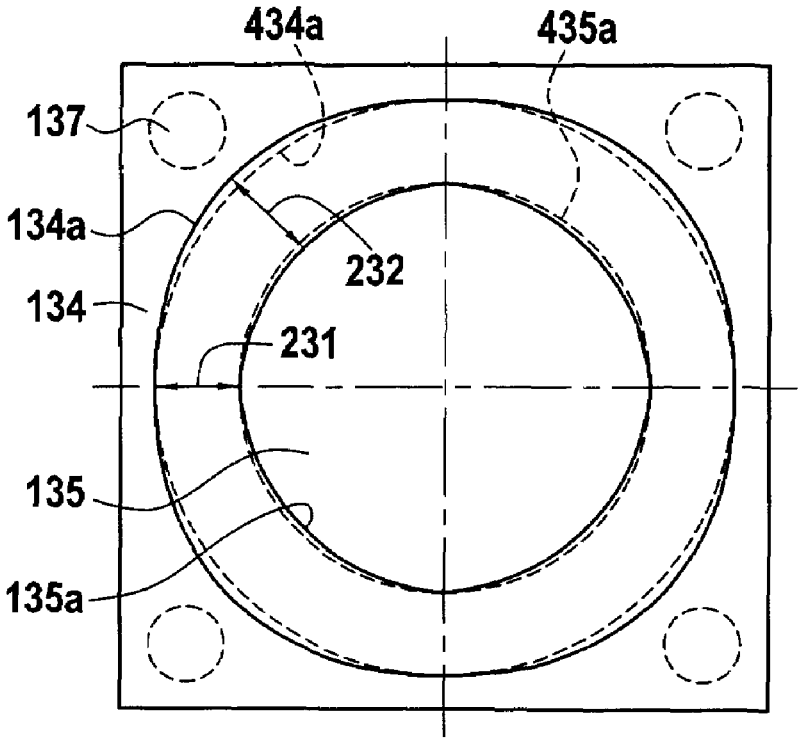
FIG. 3 is a face view of adjusted pole pieces of the FIG. 1 thruster.

In accordance with the invention, a uniform radial magnetic field is obtained in the channel 124 because the concave inner peripheral surface 134*a* of the outer pole piece 134 and the convex outer peripheral surface 135*a* of the inner pole piece 135 both present respective adjusted profiles that are different from circularly cylindrical surfaces so as to form between them a gap of varying width, presenting zones 232 of maximum value in register with the outer coils 131 and zones 231 of minimum value in between the outer coils 131 (see FIGS. 2 and 3).

In FIG. 3, dashed-line traces 434*a* and 435*a* show where the peripheral surfaces 134*a* and 135*a* would be if they were rigorously circularly cylindrical without any correction.

Figure 4:
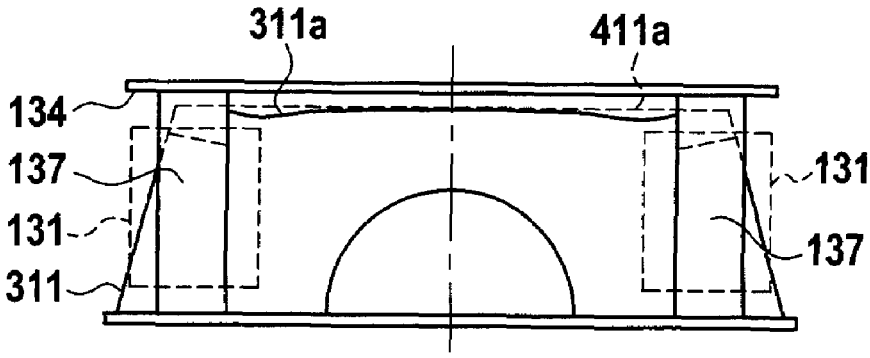
FIG. 4 is a side view of adjusted upstream pole pieces of the FIG. 1 thruster.

Furthermore, the profiled peripheral margin 351*a* of the essentially conical inner upstream pole piece 351 forming a body of revolution and the profiled peripheral margin 311*a* of the essentially conical outer upstream pole piece 311 also present respective adjusted profiles with portions that are set back along the axis of the thruster in register with the outer coils 131 so as to maintain the magnetic field profile constant in azimuth within the channel 124 (see FIGS. 1 and 4). In FIG. 4, dashed trace 411*a* represents the shape that the profiled peripheral margin 311*a* would have in the absence of any correction, i.e. if it were implemented in a manner analogous to the prior art in which said margin does not have any set-back portion.

It should be observed that in a first possible method, the correction leading to the corrected profiles 135*a*, 134*a* of the inner and outer pole pieces 135 and 134 may be calculated using three-dimensional magnetic field calculation software serving initially to calculate the increase in magnetic field in register with the outer coils 131, and then to determine the increase in gap that is needed to make the field uniform. In FIG. 3, which relates to an embodiment having four outer coils 131 mounted on cores 137 that are located substantially at the vertices of a square, it can be seen that the width of the gap is larger in the zones 232 in register with the coils 131 than in the zones 231 that are situated at 45° from the cores 137, where the width of the gap is at a minimum. In FIG. 3, there can be seen both the original profiles 434*a* and 435*a* of the peripheral surfaces of the pole pieces 134 and 135 drawn in dashed lines, and the corrected profiles of these peripheral surfaces 134*a* and 135*a* drawn in continuous lines. Once the corrections have been calculated, machining is used, e.g. involving a numerically-controlled machine, in order to obtain the desired surfaces 134*a*, 135*a*, 311*a*, and 351*a*.

It should be observed that in another possible method, the correction may be determined experimentally by an iterative procedure: after a first 3D measurement of the magnetic field on a configuration that is circularly symmetrical, a first numerically-controlled machining correction is performed and the distribution of the 3D magnetic field is measured again. A second machining operation is performed if the first correction is not satisfactory, and so on.

The present invention is also applicable to closed electron drift plasma thrusters having magnetic shields, such as those described in patent document U.S. Pat. No. 5,359,258.

Figure 6:
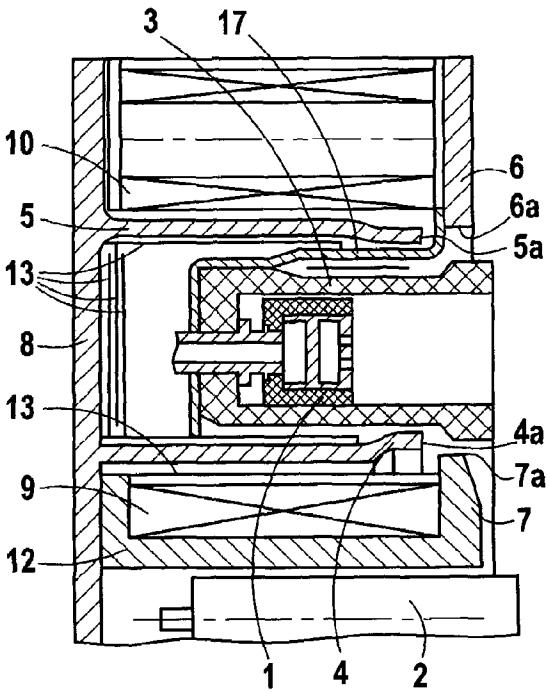
FIG. 6 is a side view of an adjusted magnetic shield of the FIG. 5 thruster.
Figure 5:
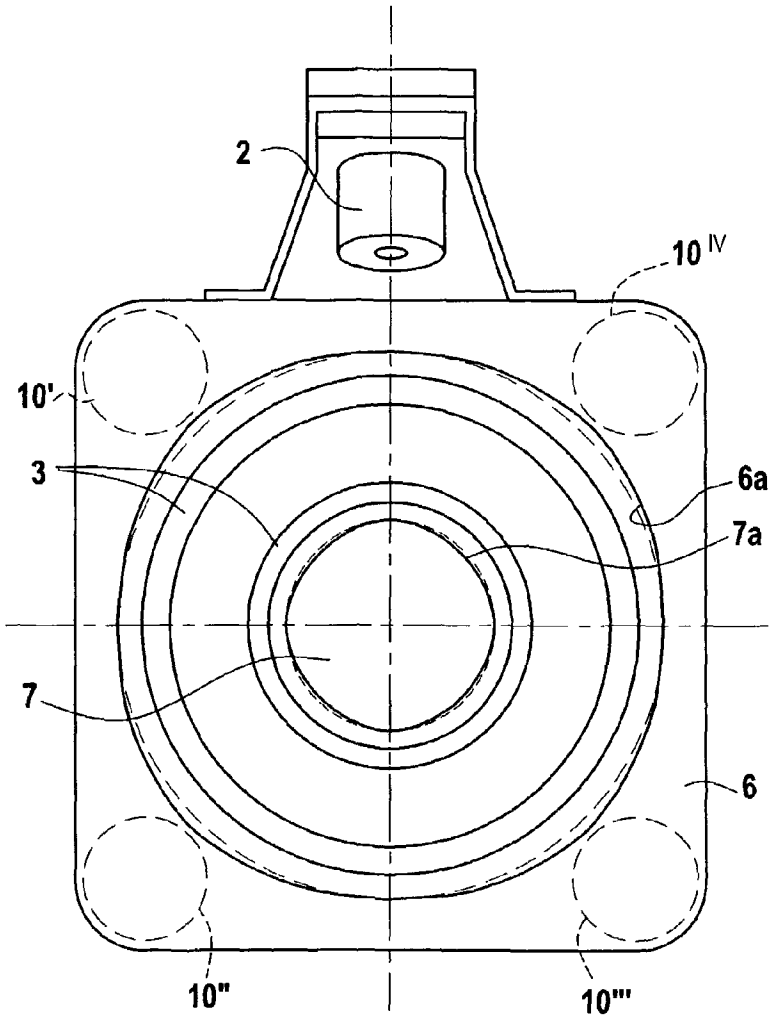
FIG. 5 is a face view of a closed electron drift thruster constituting a second embodiment of the invention.
Figure 7:
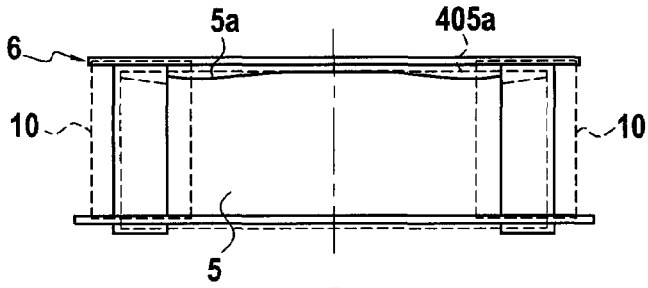
FIG. 7 is an axial half-section view of the thruster of FIGS. 5 and 6.
Figure 8:
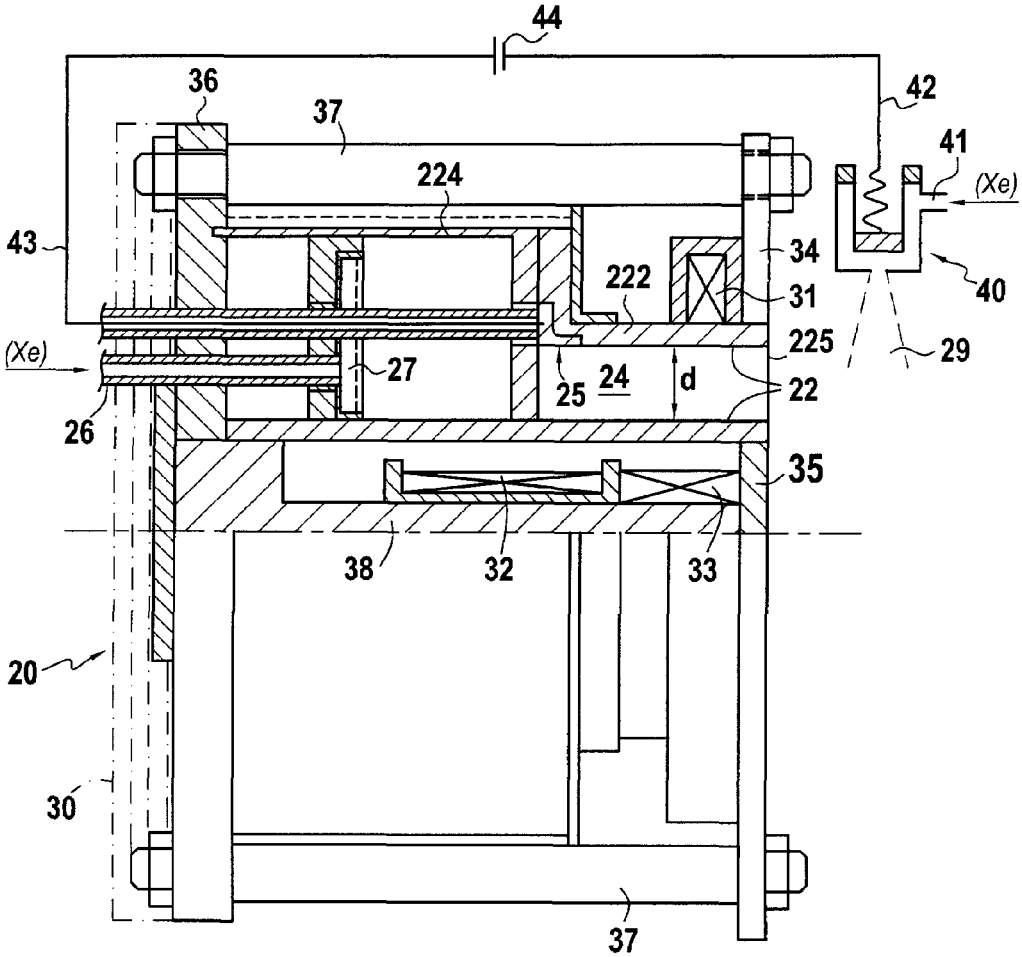
FIG.8 PRIOR ART
FIG. 8 is an elevation view in axial half-section of a closed electron drift plasma thruster with an annular outer coil of the prior art.

FIGS. 5 to 7 show such a plasma thruster with a gas manifold 1 forming an annular anode, a cathode 2, an annular discharge chamber 3, an outer magnetic shield surrounding the discharge chamber 3 and terminating in a free end surface 5*a*, an outer pole piece 6 terminating in a concave peripheral surface 6*a*, an inner pole piece 7 terminating in a convex peripheral surface 7*a*, a magnetic circuit 8, a central coil 9 creating an inner magnetic field, a plurality of outer coils 10 for creating an outer magnetic field, a central core 12, thermal shields 13, and a support 17.

In FIG. 5, there can be seen four outer coils $\mathbf{10}^{I}$, $\mathbf{10}^{II}$, $\mathbf{10}^{III}$, $\mathbf{10}^{IV}$ together with an outer pole piece 6.

As in the embodiment of FIGS. 1 to 4, the concave inner peripheral surface 6*a* of the pole piece 6 and the convex outer peripheral surface 7*a* of the pole piece 7 present respective adjusted profiles that are distinct from circularly cylindrical surfaces so as to form between them a gap of varying width presenting zones of maximum value in register with the outer coils 10 and zones of minimum value between the outer coils 10 (coils $\mathbf{10}^{I}$, $\mathbf{10}^{II}$, $\mathbf{10}^{III}$, $\mathbf{10}^{IV}$ in FIG. 5). The profiles of the non-corrected surfaces 6*a*, 7*a* (i.e. surfaces that are rigorously circular as they would appear before correction) are drawn in dashed lines in FIG. 5.

The thruster of FIGS. 5 to 7 includes an inner magnetic shield 4 that is essentially cylindrical, defining a profiled peripheral margin 4*a* at its free end that is closer to the cathode 2. The profiled peripheral margin 4*a* of the inner magnetic shield 4 and the profiled peripheral margin 5*a* of the outer magnetic shield 5 present respective adjusted profiles with portions that are set back along the axis of the thruster in register with the outer coils 10 so as to maintain the profile of the magnetic field constant in azimuth. FIG. 7 shows in continuous lines the adjusted profile of the profiled peripheral margin 5*a* and in dashed lines the initial profile 405*a* of the profiled peripheral margin 5*a* before it was adjusted.

What is claimed is:

1. A closed electron drift thruster comprising:

a main annular ionization and acceleration channel about an axis of the thruster;

at least one hollow cathode;

an annular anode concentric about the main annular channel;

a pipe and a manifold for feeding the anode with ionizable gas; and a magnetic circuit for creating a magnetic field in said main annular channel;

said magnetic circuit comprising:

at least one axial magnetic core surrounded by a first coil and by an inner upstream pole piece forming a body of revolution; and a plurality of outer magnetic cores surrounded by outer coils;

wherein said magnetic circuit further comprises an essentially radial outer first pole piece defining:

a concave inner peripheral surface; and an essentially radial inner second pole piece defining a convex outer peripheral surface; and wherein said concave inner peripheral surface and said convex outer peripheral surface present respective adjusted profiles that are distinct from circular cylindrical surfaces so as to form between them a gap of varying width presenting zones of maximum value in register with the outer coils, and zones of minimum value in between said outer coils, so as to create a uniform radial magnetic field.

2. A thruster according to claim 1, wherein said inner upstream pole piece forming a body of revolution is essentially conical and defines a profiled peripheral margin at its free end that is closer to said cathode.

3. A thruster according to claim 2, wherein said magnetic circuit further comprises an essentially conical outer upstream pole piece that defines a profiled peripheral margin at its free end closer to said cathode, and wherein said profiled peripheral margin of said essentially conical inner upstream pole piece forming a body of revolution and said profiled peripheral margin of said essentially conical outer upstream pole piece present respective adjusted profiles with portions set back along the axis of the thruster in register with the outer coils in such a manner as to keep the profile of the magnetic field constant in azimuth.

4. A thruster according to claim 1, wherein said inner upstream pole piece forming a body of revolution comprises an essentially cylindrical inner magnetic shield defining a profiled peripheral margin at its free end close to said cathode.

5. A thruster according to claim 4, wherein said magnetic circuit further comprises an essentially cylindrical outer magnetic shield that defines a profiled peripheral margin at its free end closer to said cathode, and wherein said profiled peripheral margin of said inner magnetic shield and said profiled peripheral margin of said outer magnetic shield present respective adjusted profiles with proportions set back along the axis of the thruster in register with the outer coils so as to keep the magnetic field profile constant in azimuth.

6. A thruster according to claim 1, having four outer coils surrounding four outer magnetic cores.

7. A thruster according to claim 1, having three outer coils surrounding three outer magnetic cores.

8. A thruster according to claim 1, having two outer coils surrounding two outer magnetic cores.

* * * * *